US007676883B2

(12) United States Patent
Macleod et al.

(10) Patent No.: US 7,676,883 B2
(45) Date of Patent: Mar. 16, 2010

(54) VACUUM CLEANER

(75) Inventors: Euan Skinner Macleod, New Territories (HK); John Taylor, Glasgow (GB); Ross Richardson, Auchterarder (GB); William Edwards, Bellshill (GB)

(73) Assignee: Hoover Limited, Mid Glamorgan (GB)

( * ) Notice: Subject to any disclaimer, the term of this patent is extended or adjusted under 35 U.S.C. 154(b) by 288 days.

(21) Appl. No.: 11/569,540

(22) PCT Filed: May 31, 2005

(86) PCT No.: PCT/GB2005/002160

§ 371 (c)(1),
(2), (4) Date: Jun. 27, 2007

(87) PCT Pub. No.: WO2005/117676

PCT Pub. Date: Dec. 15, 2005

(65) Prior Publication Data

US 2007/0289087 A1 Dec. 20, 2007

(30) Foreign Application Priority Data

May 29, 2004 (GB) ..... 0412137.2

(51) Int. Cl.
*A47L 9/00* (2006.01)

(52) U.S. Cl. ..... 15/334; 15/335; 15/337

(58) Field of Classification Search ..... 15/331–337, 15/352

See application file for complete search history.

(56) References Cited

U.S. PATENT DOCUMENTS

| | | | | |
|---|---|---|---|---|
| 4,571,772 | A | 2/1986 | Dyson et al. | |
| 4,573,236 | A | 3/1986 | Dyson | |
| 5,331,715 | A | 7/1994 | Johnson et al. | |
| 5,355,549 | A * | 10/1994 | Steinberg et al. | 15/334 |
| 5,983,442 | A | 11/1999 | Louis et al. | |
| 6,079,077 | A * | 6/2000 | Kajihara et al. | 15/332 |
| 6,317,920 | B1 | 11/2001 | Brickner et al. | |
| 6,572,078 | B1 * | 6/2003 | Thomson et al. | 251/162 |
| 2002/0112315 | A1 | 8/2002 | Conrad | |
| 2003/0101535 | A1 | 6/2003 | Gammack et al. | |
| 2004/0194247 | A1 * | 10/2004 | Macleod et al. | 15/335 |

FOREIGN PATENT DOCUMENTS

| | | |
|---|---|---|
| EP | 1464267 | 10/2004 |
| GB | 1394497 | 5/1975 |
| JP | 2002-233483 | 8/2002 |
| WO | WO0021425 | 4/2000 |

* cited by examiner

*Primary Examiner*—Dung Van Nguyen
(74) *Attorney, Agent, or Firm*—Gordon & Jacobson, PC

(57) ABSTRACT

A changeover valve, for an upright vacuum cleaner, comprises a movable valve member (31) connected via a flexible duct to a dirt separator of the cleaner, and a valve body (30) having inlet ports (32, 33) connected, respectively, to an air inlet in the underside of a floor-engaging unit of the cleaner and, via a flexible hose, a suction nozzle of the cleaner. The valve member (31) is movable relative to the valve body (30) for selective alignment with either of the inlet ports (32, 33).

4 Claims, 3 Drawing Sheets

VACUUM CLEANER

BACKGROUND OF THE INVENTION

This invention relates to a vacuum cleaner and to a suction changeover valve for the vacuum cleaner.

Known vacuum cleaners are either of the so-called upright type or the so-called cylinder type. Upright vacuum cleaners comprise an upright body pivotally connected at its lower end to a wheeled floor-engaging unit for partial rotation forwardly and rearwardly about a transverse axis. The upright body encloses a motor/fan unit which develops suction for drawing air through an inlet in the floor-engaging unit of the cleaner and then through a dust separation device. A handle is provided at the upper end of the upright body for manoeuvring the cleaner. A motor-driven, rotary agitator brush is mounted across the inlet in the floor-engaging unit to beat and sweep the floor in the region of the airflow into the cleaner.

Cylinder vacuum cleaners comprise a body which encloses a motor/fan unit which draws air into a dust separation device though an elongate flexible hose. A plurality of tools are provided for fitting to the end of the hose.

Upright vacuum cleaners are better at cleaning carpets than cylinder vacuum cleaners because of the action of the rotating agitator brush. However, cylinder vacuum cleaners are better suited for above-floor cleaning and for cleaning in places where an upright cleaner cannot be used.

In order to provide a cleaner having the advantages of both upright and cylinder cleaners, it is known to provide an upright cleaner having an elongate flexible hose, the inlet of which can either be connected to the floor-engaging unit of the cleaner for conventional floor cleaning, or connected to an extension tube and/or cleaning tools for above-floor cleaning.

A disadvantage of this arrangement is that during conventional floor cleaning, the airflow though the cleaner is partially restricted by the elongate flexible hose, which is coiled for storage on the back of the cleaner. The coiled length of hose is also susceptible to blockage.

In order to overcome the above-mentioned problem, vacuum cleaners of the upright type are known which comprise a hose and a valve which can be actuated such that the suction is either applied to the hose for above-floor cleaning or to the floor-engaging unit of the cleaner for conventional floor cleaning.

European Patent No. 1,121,043 discloses an upright cyclonic vacuum cleaner of the above-mentioned type, comprising an elongate rigid tube, which is mounted vertically to the rear of the cleaner body and which forms a handle for manoeuvring the cleaner during conventional floor cleaning. The cyclonic separator is connected to the outlet of a first member of a two-way valve. The valve further comprises a second valve member having a first inlet port connected to the air inlet on the underside of the floor-engaging unit and a second inlet port connected to the elongate rigid tube.

The valve is arranged to connect the cyclonic separator to the air inlet on the underside of the floor-engaging unit when the upright body of the cleaner is pivoted rearwardly relative to the floor-engaging unit of the cleaner. In order to carry out above-floor cleaning, the upright body of the cleaner is pivoted forwardly into its upright position relative to the floor-engaging unit of the cleaner, to divert the suction airstream from the floor-engaging unit of the cleaner to the elongate rigid tube.

The outlet port of the first member of the valve is provided with a resilient seal. Wear and potential damage to the seal due to sliding contact with the second valve member is eliminated by providing a cam-and-follower mechanism whereby the seal is disposed out of sliding contact with the second valve member during changeover movements. This mechanism adds to the complexity of the valve.

U.S. Pat. No. 5,732,439 discloses a valve comprising a flap, which is responsive to the attitude of the cleaner handle (whether rearwardly inclined for floor cleaning, or upright for above-floor cleaning) to route the suction airstream to the separator unit from one or other of two inlets. The valve comprises a pivoted flap located in a chamber to which the separator inlet duct, and dirty air ducts from the floor nozzle and hose respectively, are connected. Dependent on the momentary position of the flap, one of the dirty air inlets is blocked whilst the other dirty air inlet remains open. The valve responds to a change in attitude of the cleaner handle, between upright and inclined positions, to switch the dirty air path from one dirty air inlet to the other. The mechanism required to effect reliable operation of such valve arrangements, with acceptable levels of sealing, is relatively complex, involving cams, springs and linkages to actuate the flap.

Alternative actuating mechanisms for changeover flap valves are known whereby removal of above-floor cleaning apparatus from its stored position on the body of the cleaner gives rise to switching of the valve. Such an arrangement is disclosed in United Kingdom Patent No. 2,291,336. Manually operable valves are also known.

SUMMARY OF THE INVENTION

We have now devised a vacuum cleaner having a changeover valve which is less complicated than changeover valves hitherto known in vacuum cleaners.

In accordance with this invention, as seen from a first aspect, there is provided a vacuum cleaner comprising:

a floor-engaging unit having a first air inlet on the underside thereof:

an upright body pivotally connected at its lower end to said floor-engaging unit;

a detachable handle upstanding from said upright body and having a rigid tubular duct extending between a second air inlet at one end of the handle and an outlet disposed remote from said one end;

an elongate flexible hose having a first end and a second end, the first end of the hose being connected to said outlet on said handle; and a changeover valve comprising a movable valve member having an airflow outlet connected via a flexible duct to a separator for separating dirt and dust from an airflow through the cleaner, and a valve body having a first airflow inlet connected to said first air inlet on the underside of said floor-engaging unit and a second airflow inlet connected to said second end of said elongate flexible hose, said valve member being movable relative to the valve body for selective alignment of said airflow outlet with either of said airflow inlets.

The flexible duct permits the valve member to move relative to the valve body to switch the airflow between the first and second air inlets for floor and above-floor cleaning, respectively.

Preferably the first and second airflow inlets of the valve body extend at an inclined angle of preferably 90 degrees to each other, said valve member being rotatable relative to said valve body for selective alignment with said airflow inlets.

Preferably the valve member is moved by means arranged to engage said handle, such that removal of the handle for above-floor cleaning switches the airflow from the first air inlet to the second air inlet.

The airflow outlet of the movable valve member is preferably provided with a circumferential, resilient seal for sealing against valve seats with which the valve body is formed, for said first and said second airflow inlets of the valve.

Preferably the seal is out of contact with the valve seats of said first and second airflow inlets of the valve during relative movement of the valve member.

In one embodiment, the valve member is further arranged to move axially relative to said first and second airflow inlets during changeover, in order to prevent wear and to provide improved sealing.

In an alternative embodiment, the seal is arranged such that when suction is applied to the valve, a pressure differential arises across an edge zone of the seal to cause the seal to be brought into contact with the respective valve seat of the valve body.

Preferably the seal comprises a substantially annular lip, the lip normally extending radially outwardly and arranged to deform axially outwardly to seal against the respective valve seat of the valve body when suction is applied to the valve.

Also in accordance with this invention, as seen from a second aspect, there is provided a changeover valve comprising a first valve member having a first port, and a second valve member having second and third ports, said valve members being movable relative to each other for selective alignment of said first port with either of said second and third ports, a seal being provided on said first valve member which is normally out of contact with said second valve member when suction is applied to the valve via one of said ports.

Preferably the seal comprises a substantially annular lip, the lip normally extending radially outwardly and arranged to deform axially outwardly to seal against the second valve member when suction is applied to the valve.

An embodiment of the invention will now be described by way of example only and with reference to the accompanying drawings.

DETAILED DESCRIPTION OF THE PREFERRED EMBODIMENTS

Figure 1:
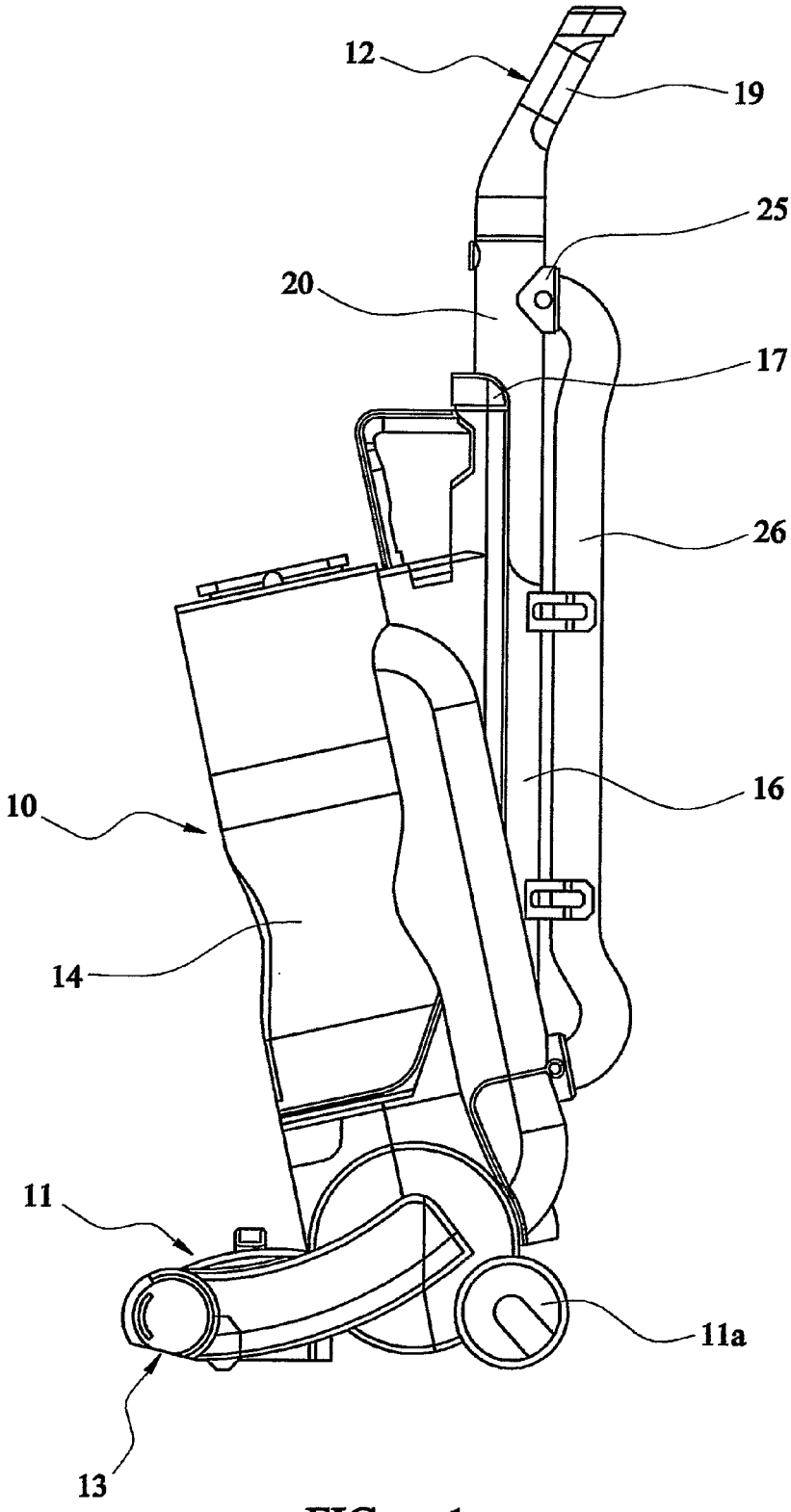
FIG. 1 is a side view of an upright vacuum cleaner in accordance with this invention, the cleaner being shown when configured for floor cleaning.
Figure 2:
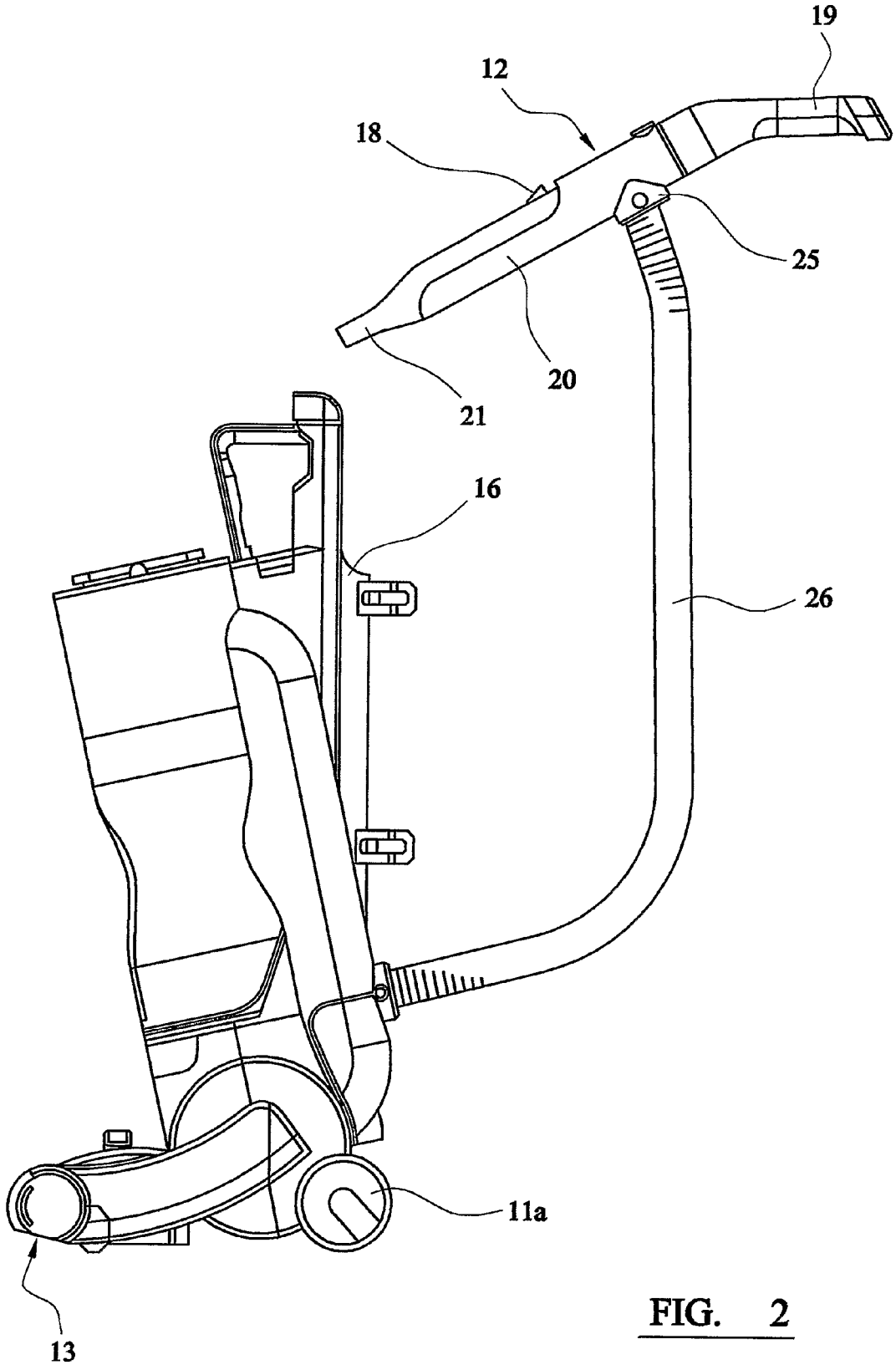
FIG. 2 is a similar view of the cleaner, when configured for above-floor cleaning.

Referring firstly to FIGS. 1 and 2 of the drawings, there is shown an upright vacuum cleaner which comprises an upright body 10 pivotally mounted, at its lower end, to a floor-engaging unit 11, enabling partial rotation of the upright body 10 forwardly and rearwardly relative to the floor-engaging unit 11, about an axis which extends transverse the cleaner. A motor/fan unit is housed within the body 10, to develop suction for drawing air into the cleaner and though a cylindrical, cyclone separation unit 14, which is mounted to the front of the body 10 and serves to separate dirt and dust from the incoming airflow and to collect this dirt and dust. A first suction inlet 13 is provided on the underside of the floor-engaging unit 11 and a motor-driven, rotary agitator brush (not shown) is mounted across the unit 11, in the inlet 13. The floor engaging unit 11 is provided with a pair of floor-engaging wheels 11*a*.

The cleaner further comprises an elongate handle 12 which is shown, in FIG. 1, inserted into a vertical socket 16 formed in the rear of the upright body 10 of the cleaner. A catch 17 is provided, adjacent the top of the socket 16, to engage a barb 18 on the side of the handle 12, to retain the latter in the socket 16. The catch 17 may be released manually, to enable the handle 12 to be removed from its socket 16. The handle 12 comprises a tubular suction inlet 20 formed at its rearward end as a handgrip 19: the forward end of the tubular suction inlet 20 is tapered and changes from a circular cross-section to form a so-called crevice tool 21. A flexible suction hose 26 is connected at one end to an outlet 25 formed in the side of the tubular suction inlet 20, adjacent its junction with the handgrip 19, and is connected at its other end to the upright body 10 of the cleaner. When the handle 12 is retained in its socket 16, the handgrip 19 serves for manoeuvring the cleaner over the floor: when the handle 12 is removed from its socket 16, the handgrip 19 serves for manoeuvring the tool 21.

A changeover valve is housed within the upright body 10 of the cleaner, and in one position serves to communicate suction to the inlet 13 in the floor-engaging unit 11 for use of the cleaner in floor cleaning, whilst in a second position serves to communicate suction to the flexible hose 26 and hence to the suction inlet 20 and tool 21 for use of the cleaner in above-floor cleaning. When the handle 12 is inserted into the socket 16, as shown in FIG. 1, its end bears on an actuating member of the changeover valve and depresses this actuating member against a spring bias: depression of the actuating member serves to hold the valve in its first position, in which suction is communicated to the inlet 13 in the floor-engaging unit 11. When the handle 12 is removed from the socket 16, as shown in FIG. 2, the actuating member of the valve is free to move under its spring bias, and changes the valve to its second position, in which suction is communicated to the tool 21 via the flexible hose 26.

Figure 4:
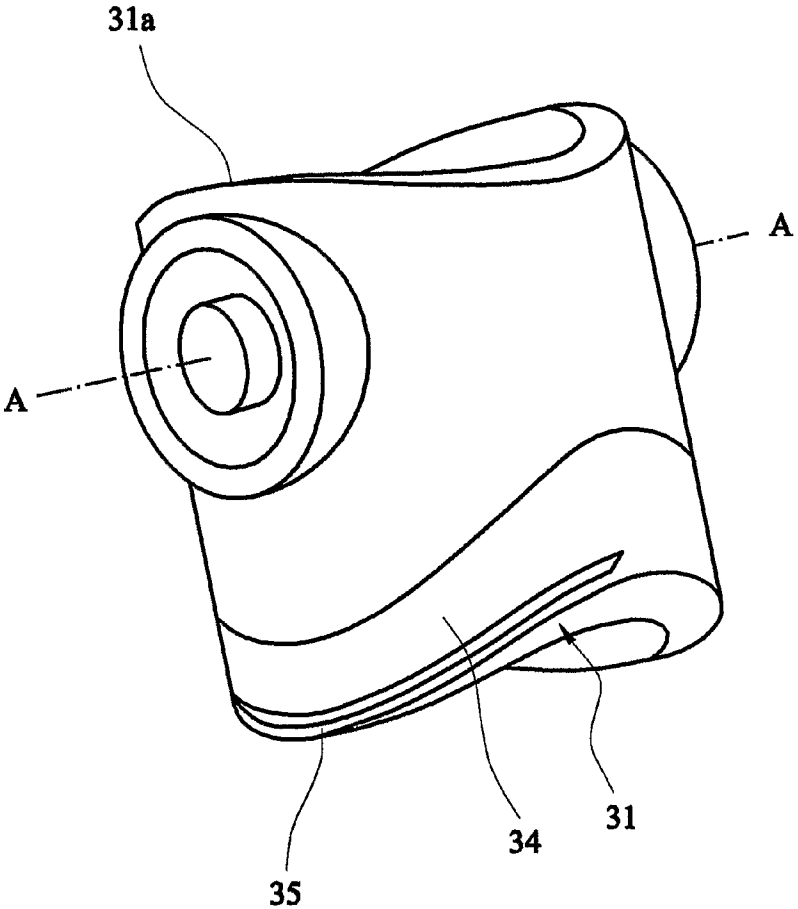
FIG. 4 is a perspective view of a movable valve member of the valve of FIG. 3.
Figure 3:
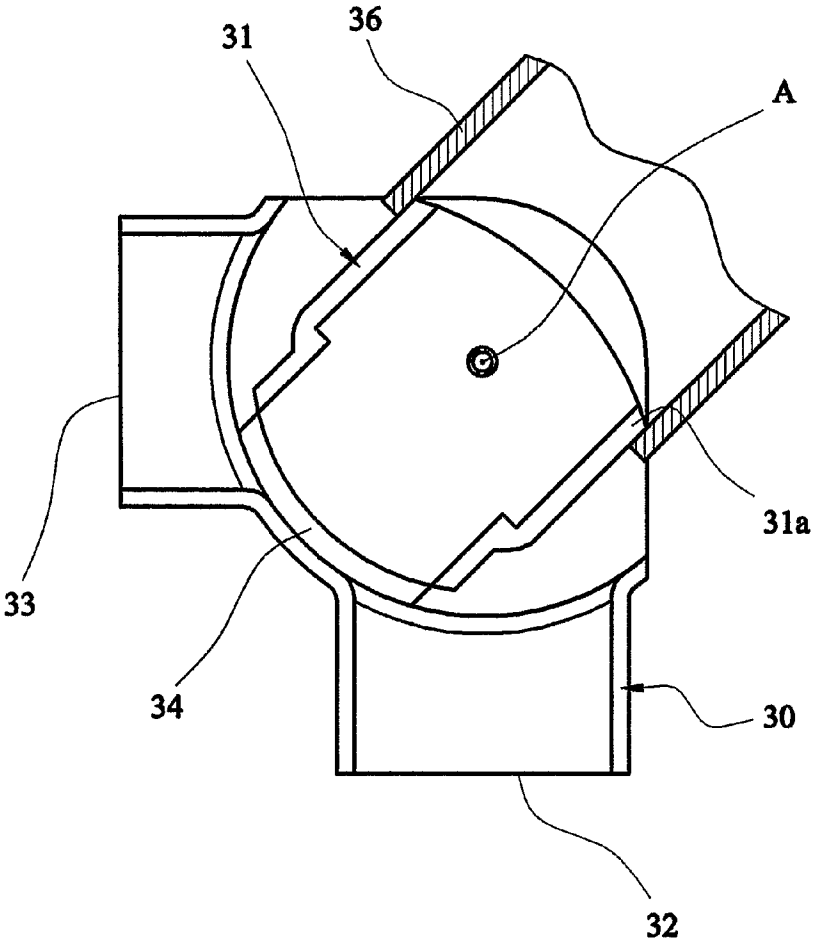
FIG. 3 is sectional view through a changeover valve of the vacuum cleaner.

FIGS. 3 and 4 show the changeover valve of the vacuum cleaner. Referring to FIG. 3, the valve comprises a movable valve member 31 and a valve body 30. The valve member 31 is tubular and is rotatably mounted to the valve body 30 for rotation about an axis A-A which extends perpendicular to a flow duct extending through the valve member 31.

The valve body 30 comprises a first air inlet port 32 of tubular form, connected to the air inlet 13 on the underside of the floor-engaging unit 11 of the cleaner, and a second air inlet port 33 of tubular form, connected via the flexible hose 26 to the tool 21 for above-floor cleaning. The ports 32, 33 are arranged at 90 degrees to each other.

The valve member 31 is connected at one end 31*a* to the dust separation device via a flexible hose 36 which allows the first valve member 31 to rotate freely.

The opposite end of the valve member 31 is arcuate in side view and is provided with a circumferential seal 34 for sealing against the valve body 30, and in particular against annular seats with which the valve body is formed, at the inner ends of the respective tubular inlet ports 32, 33, these seats also being arcuate in side view to complement the arcuate end profile of the valve member 31.

Referring to FIG. 4 of the drawings, the seal 34 comprises a lip 35 which normally extends radially outwardly in its as-formed condition but which is arranged to deform axially outwardly to seal against one or other of the annular seats of the valve body 30 when suction is applied to the valve.

In its normal configuration, the lip 35 is disposed a small distance away from the valve body 30 and thus the valve member 31 can rotate freely between the ports 32, 33. This also prevents wear on the seal 35. However, when the valve member 31 is aligned with one of the ports 32 or 33 and the cleaner is activated, the suction applied to the valve causes the lip 35 to deform axially outwardly to seal against the respective annular seat of the valve body 30.

It will be appreciated that the changeover valve which has been described is of simple construction yet effective in use and its sealing arrangement will experience minimal wear.

The invention claimed is:

1. A vacuum cleaner, comprising:

a floor-engaging unit having a first air inlet on the underside thereof;

an upright body pivotally connected at its lower end to said floor-engaging unit;

a detachable handle upstanding from said upright body and having a rigid tubular duct extending between a second air inlet at one end of the handle and an outlet disposed remote from said one end;

an elongate flexible hose having a first end and a second end, the first end of the hose being connected to said outlet on said handle; and a changeover valve comprising a movable valve member having an airflow outlet connected via a flexible duct to a separator for separating dirt and dust from an airflow through the cleaner, and a valve body having a first airflow inlet in fluid communication with said first air inlet of said floor-engaging unit and a second airflow inlet in fluid communication with said second end of said elongate flexible hose, said valve member being movable relative to the valve body for selective alignment of said airflow outlet of said valve member with either of said airflow inlets of said valve body, wherein, said valve body defines at least one valve seat, said valve member is provided with a circumferential, resilient seal which does not contact said at least one valve seat of said valve body when said valve member is moved relative to said valve body, wherein, when said airflow outlet of said valve member is aligned with one of said first and second airflow inlets of said valve body, suction applied at said airflow outlet of said valve member causes a pressure differential to be created across an edge zone of said seal to cause said resilient seal of said valve member to be brought into contact with a respective valve seat of said valve body, and wherein said seal comprises a substantially annular lip which extends radially outwardly in the absence of applied suction, and which is arranged to deform axially outwardly to seal against the respective valve seat when suction is applied to said airflow outlet.

2. A vacuum cleaner as claimed in claim 1, wherein:

said first and second airflow inlets of said valve body extend at an inclined angle to each other, said valve member being rotatable relative to said valve body.

3. A vacuum cleaner as claimed in claim 2, wherein:

said inclined angle is 90 degrees.

4. A changeover valve, comprising:

a first valve member having a first port;

a second valve member having second and third ports, said valve members being movable relative to each other for selective alignment of said first port with either of said second and third ports; and a seal provided on said first valve member which only contacts and seals against said second valve member when suction is applied to said changeover valve via one of said ports;

wherein said seal comprises a substantially annular lip which extends radially outwardly in the absence of applied suction, and which is arranged to deform axially outwardly to seal against said second valve member when suction is applied to said changeover valve.

* * * * *